United States Patent [19]

Pope

[11] 4,098,675

[45] Jul. 4, 1978

[54] PREVENTING AMMONIUM CHLORIDE DEPOSITION

[75] Inventor: Max D. Pope, Woods Cross, Utah

[73] Assignee: Phillips Petroleum Company, Bartlesville, Okla.

[21] Appl. No.: 813,553

[22] Filed: Jul. 7, 1977

[51] Int. Cl.[2] ..... C10G 9/16; C10G 13/00; B65G 53/04

[52] U.S. Cl. ..... 208/108; 208/48 R; 208/95; 208/133; 208/213; 208/254 H; 302/66

[58] Field of Search ..... 208/108, 213, 95, 254 H, 208/48 R, 133; 302/66

[56] References Cited

U.S. PATENT DOCUMENTS

| | | | |
|---|---|---|---|
| 2,872,936 | 2/1959 | Richardson | 137/172 |
| 2,929,772 | 3/1960 | Gilmore | 208/99 |
| 3,527,059 | 9/1970 | Rust et al. | 62/115 |

*Primary Examiner*—Delbert E. Gantz
*Assistant Examiner*—G. E. Schmitkons

[57] ABSTRACT

Deposition of ammonium chloride from a gaseous stream as it is passed through a compression means is prevented by recycling to the compression suction a sufficient amount of the compression means discharge that has been heated by the compression operation to maintain the temperature of the gaseous stream above the deposition temperature for ammonium chloride at operating pressure. The invention is particularly useful in hydrocarbon hydrogen treating processes in which hydrogen recycle streams containing ammonium chloride or ammonium chloride-forming constituents must be recompressed before recycle to the hydrogen treating process.

9 Claims, 1 Drawing Figure

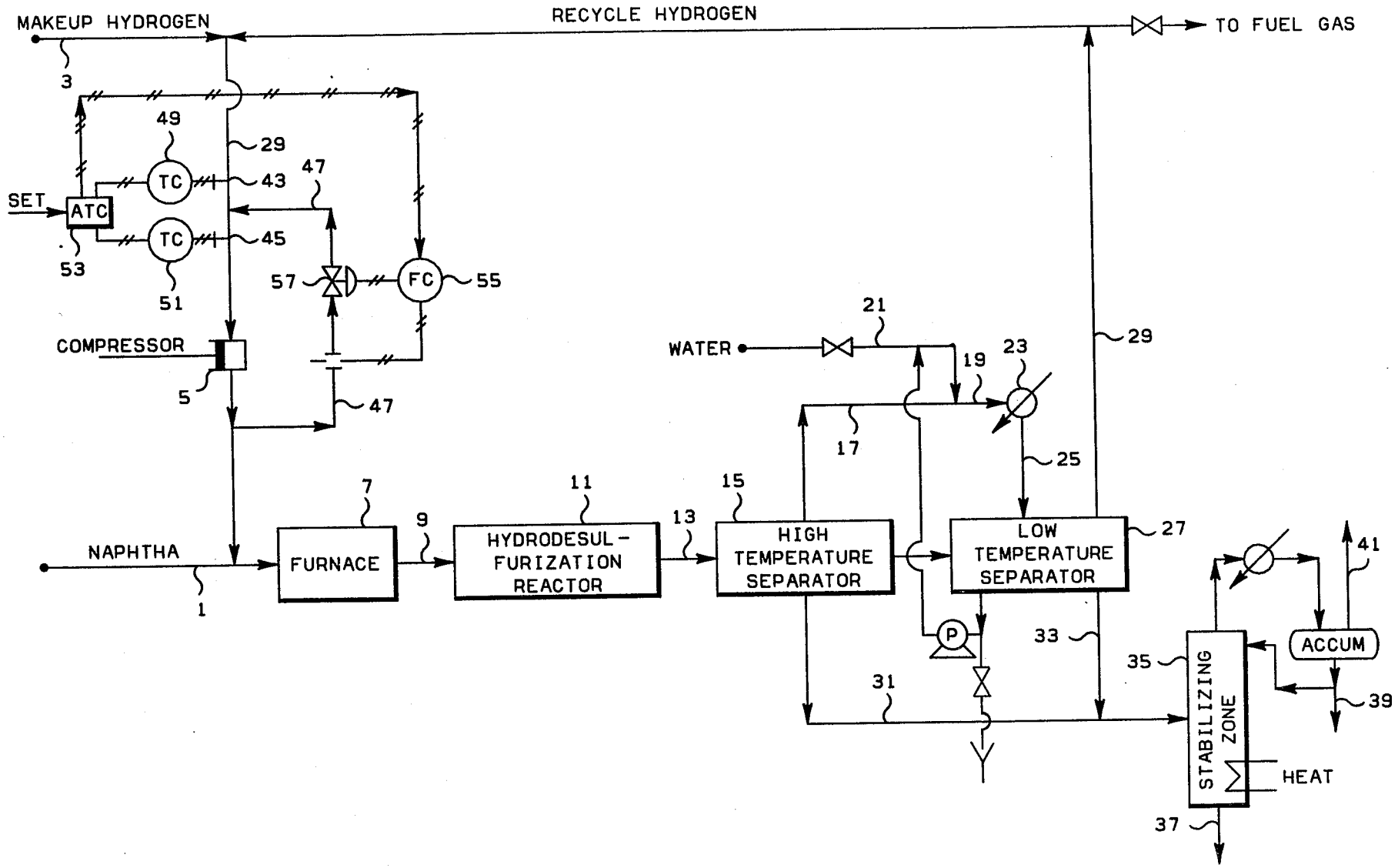
TO FUEL GAS
RECYCLE HYDROGEN
MAKEUP HYDROGEN
3
29
43
45
49
TC
TC
51
ATC
53
SET
COMPRESSOR
5
47
47
57
FC
55
NAPHTHA
1
7
FURNACE
9
11
HYDRODESUL-
FURIZATION
REACTOR
13
15
HIGH
TEMPERATURE
SEPARATOR
WATER
21
17
19
23
25
LOW
TEMPERATURE
SEPARATOR
27
P
29
33
31
35
STABILIZING
ZONE
HEAT
37
ACCUM
39
41

PREVENTING AMMONIUM CHLORIDE DEPOSITION

BACKGROUND OF THE INVENTION

This invention relates to the condensing and depositing of ammonium chloride contained in gaseous process streams. In one of its aspects this invention relates more particularly to hydrocarbon hydrodesulfurization, hydrodenitrogenation, hydrocracking, and reforming processes. In still another of its aspects this invention relates to a process in which ammonium chloride is present in a gaseous stream that must be subjected to gas compression with prevention of depositing of the ammonium chloride in the gas-compressing zone.

This invention is of particular interest in hydrodesulfurization processes in which hydrocarbon stock is passed along with hydrogen into a catalytic hydrodesulfurization zone in which they are contacted with a catalyst, usually a cobalt-molybdenum or nickel-molybdenum on alumina support catalyst, at a temperature and pressure sufficient to produce desulfurized hydrocarbons, hydrogen, and other gases. It is well known that, usually, among the products in a hydrodesulfurization effluent stream are ammonium chloride or ammonium chloride-forming constituents. On passing any part of the gaseous effluent stream containing ammonium chloride or ammonium chloride-forming constituents through a compressing zone there is a risk of problems with depositing of ammonium chloride on the equipment in the compressing zone. In turbine compressors, deposits of a solid ammonium chloride on the blades of the compressor can unbalance the blades and necessitate expensive shutdown. In reciprocating compressors the valve ports can become plugged, again necessitating expensive shutdown of the operation.

Various methods have been proposed for eliminating the depositing. These methods usually entail the removal of ammonium chloride or ammonium chloride-forming constituents from the process streams. As an example, U.S. Pat. No. 2,929,772 contacts the gas streams with an adsorbent or an absorbent upstream of the gas-compressing zone to remove the ammonium chloride or ammonium chloride-forming components. Other processes reduce the temperature to induce depositing in a zone from which the deposits can easily be washed prior to passing any portion of the reforming process effluent through a compression zone. Both of these methods require fairly expensive equipment which may leave a sufficient amount of material in the gas stream to allow troublesome deposits. The method of this invention provides relatively inexpensive means to prevent deposition within a given portion of the process such as a compression zone. The method is particularly effective when used along with means for removing at least some of the ammonium chloride or ammonium chloride-forming constituents.

It is therefore an object of this invention to provide a method for preventing depositing of ammonium chloride from a gaseous stream containing ammonium chloride or ammonium chloride-forming constituents. It is another object of this invention to prevent the deposition of ammonium chloride in the compression zone for hydrogen recycle in a catalytic hydrodesulfurization process.

Other aspects, objects, and the various advantages of this invention will become apparent upon study of this specification, the drawing, and the appended claims.

STATEMENT OF THE INVENTION

According to the invention a method is provided for preventing depositing of ammonium chloride from a gaseous stream containing ammonium chloride or ammonium chloride-forming constituents as the gaseous stream is passed through a compression means. The method comprises recycling to the compression means inlet an amount of compression means discharge sufficient to maintain the temperature of the compression means inlet above deposition temperature for ammonium chloride at the operating pressure. Although this method has arisen from experience in catalytic hydrodesulfurization processes, and is therefore particularly applicable in the manipulation of hydrogen recycle streams in a hydrodesulfurization process, it is also broadly applicable to any gaseous stream from which it is desirable to prevent the deposition of ammonium chloride, as in hydrocracking, hydrodenitrogenation, and reforming.

In a preferred embodiment of the invention, apparatus and method are provided for automatically controlling the amount of compression means discharge recycled to the compression means inlet by sensing the temperature differential in the compression means inlet stream before and after (upstream and downstream) the point of addition of the recycled compression means discharge and controlling the flow of recycle from discharge to inlet in response to a set differential in these temperatures.

The invention can best be understood in conjunction with the drawing which is a line diagram of a naphtha catalytic hydrodesulfurization unit using conventional cobalt-molybdenum on alumina hydrodesulfurization catalysts. The unit contains a recycle hydrogen line that is passed through a compression zone.

Referring now to the drawing, about 10,500 barrels per day of hydrocarbon feed containing 100 parts per million (ppm) by weight of sulfur is passed through line 1 along with about 3.8 million standard cubic feet per day of make-up hydrogen containing up to about 1 ppm of hydrogen chloride through line 3 and 3.5 million standard cubic feed per day via compressor 5 of recycle hydrogen, containing ammonium chloride vapor in an amount of about 0.01 ppm by weight, into the hydrodesulfurization heater 7. In the heater the temperature is raised from approximately 450° F (232° C) at a pressure of 460 psig (3175 kPa gage) to a temperature of about 600° F (316° C) at 420 psig (2900 kPa gage). The heated stream is passed through line 9 into the hydrodesulfurization reactor 11 in which catalytic hydrodesulfurization takes place. Nitrogen compounds in the stock to be hydrodesulfurized and the hydrogen chloride present in the hydrogen stream and that produced from organic chlorides in the feed provide the necessary constituents in the hydrodesulfurization reactor to provide either ammonium chloride or ammonium chloride-forming constituents (ammonia and hydrogen chloride) in the reactor effluent.

In hydrodesulfurization, besides sulfur compounds, the feed contains nitrogen compounds, and some feeds contain organic chloride and organic nitrogen compounds. The source of hydrogen used is usually from a reforming operation (naphtha reforming) which yields hydrogen. HCl or other chlorides are added to such reforming operations and are one source of HCl added to hydrodesulfurization in this hydrogen stream. Also, in some operations ammonia is added to the water added to a vapor stream recovered from hydrodesulfurization to minimize corrosion in the system.

The reactor effluent is passed by line 13 to a high-temperature separator 15 from which vapor at about 335° F (168.8° C) and 370 psig (2550 kPa gage) is withdrawn through line 17. This vapor can contain up to about 15 to 20 pounds per day of ammonium chloride or ammonium chloride-forming constituents. The vapor from line 17 is contacted with water in line 19, make-up water being added from line 21, passed through indirect cooling 23, line 25, and into a low-temperature separator 27. This removes the major portion of the hydrogen chloride and ammonia as ammonium chloride in the water. On exit from the low-temperature separator 27 the recycle hydrogen stream passing into line 29 has reached a temperature of about 100° F (38° C) at about 350 psig (2415 kPa gage). These conditions are such that ammonia and hydrogen chloride or ammonium chloride are present in the recycle hydrogen and there is the problem of deposition of ammonium chloride in the recycle compressor and conduits associated therewith.

Liquid hydrocarbon from the high-temperature separator 15 is passed through line 31 which is joined by hydrocarbon liquid passed through line 33 from the low-temperature separator 27 into a stabilizing system 35 from which a bottoms stream of about 6,000 barrels per day of hydrocarbons containing less than 1 ppm sulfur is withdrawn through line 37, an overhead liquid stream of about 4,000 barrels per day of hydrocarbon is withdrawn through line 39 and an overhead gas stream of about 1 million standard cubic feet per day is withdrawn through line 41.

The recycle hydrogen stream withdrawn from the low-temperature separator 27 through line 29 contains about 0.01 ppm by weight ammonium chloride or ammonium chloride-forming constituents at a temperature of about 100° F (38° C) and at 350 psig (2415 kPa gage). The experience with this stream indicates, and a calculation from published data corroborates, that at these conditions deposition of ammonium chloride from the hydrogen recycle stream can be expected with any further drop in temperature. Under actual operating plant conditions there is enough natural heat exchange during winter weather to cause condensation and depositing of the ammonium chloride either in the compression zone 27 or in line 29 to be carried into the compression zone. To prevent this deposition or to remove deposits carried into the compression zone sufficient heat must be supplied in the compression zone to raise the temperature at the inlet of the compression means to the range of about 105° to about 110° F (40.8°–43° C) at 350 psig (2415 kPa gage) which is sufficient to maintain ammonium chloride as vapor in the hydrogen stream. This heating is accomplished by recycling a sufficient amount of gaseous discharge from the compression means, which discharge has been increased in temperature ($+\Delta T$) in the range of about 20° to about 100F° (11°–56C°) by the compression operation, back to a point upstream of the compression means inlet.

The amount of compressor discharge recycled is automatically controlled by sensing the temperature in the compression means suction line 29 at a point upstream 43 and a point downstream 45 of the point at which compressor discharge recycle line 47 ties into the compression means suction line 29. These temperatures are converted to signals by means 49, 51 and transmitted to differential temperature controller 53 which is set for about 5 to about 25° F, preferably about 15° F which generates a signal that is transmitted to flow controller 55 which controls flow control valve 57 in the compressor discharge recycle line 47 to admit a sufficient amount of compressor discharge back to the compressor suction line 29 to maintain temperatures set in differential temperature controller 53 as a difference between the temperatures sensed at the upstream point 43 and the downstream point 45 in the compressor suction line. Typically, about 30 percent recycle of compressed hydrogen should be used to insure that there are no deposits of solid ammonium chloride. For each 100 standard cubic feet of total hydrogen charged to the compressor 30 standard cubic feet of this total is recycled from the compressor discharge to the compressor suction.

I claim:

1. A method for preventing depositing of ammonium chloride from a gaseous stream containing ammonium chloride or ammonium chloride-forming constituents as the gaseous stream is passed through a compression means, said method comprising recycling to the compression means inlet an amount of compression means discharge sufficient to maintain the temperature of the compression means inlet above deposition temperature for ammonium chloride at the operating pressure.

2. A method of claim 1 wherein said gaseous stream is a hydrogen stream.

3. A method of claim 2 wherein said hydrogen stream is a process stream being recycled through a compression step of a chemical process operation.

4. A method of claim 3 wherein said process is a hydrogen treating process.

5. A method of claim 4 wherein said hydrogen treating process is catalytic hydrodesulfurization.

6. A method of claim 3 wherein said process is a hydrocracking process.

7. A method of claim 3 wherein said process is a hydrodenitrogenation process.

8. A method of claim 3 wherein said process is a hydrogen reforming process.

9. A method of claim 1 wherein the amount of compression means discharge recycled to the compression means inlet is automatically controlled by sensing the temperature differential in the compression means inlet stream before and after the point of addition of the recycle means discharge with flow of recycle from discharge to inlet responding to a set temperature differential.

* * * * *